US007247055B2

(12) United States Patent
Watanabe

(10) Patent No.: US 7,247,055 B2
(45) Date of Patent: Jul. 24, 2007

(54) CARD CONNECTOR

(75) Inventor: Yoshinori Watanabe, Kanagawa (JP)

(73) Assignee: Tyco Electronics AMP K.K., Kanagawa-Ken (JP)

( * ) Notice: Subject to any disclaimer, the term of this patent is extended or adjusted under 35 U.S.C. 154(b) by 0 days.

(21) Appl. No.: 11/327,080

(22) Filed: Jan. 6, 2006

(65) Prior Publication Data

US 2006/0154528 A1 Jul. 13, 2006

(30) Foreign Application Priority Data

Jan. 7, 2005 (JP) ..... 2005-002745

(51) Int. Cl.
*H01R 24/00* (2006.01)

(52) U.S. Cl. ..... 439/630; 439/325

(58) Field of Classification Search ..... 439/159, 439/160, 325, 385, 630
See application file for complete search history.

(56) References Cited

U.S. PATENT DOCUMENTS

| | | | | |
|---|---|---|---|---|
| 4,838,804 | A * | 6/1989 | Banjo et al. | 439/325 |
| 6,607,404 | B1 | 8/2003 | Ito et al. | |
| 6,773,280 | B2 * | 8/2004 | Sasaki et al. | 439/159 |
| 6,932,652 | B1 * | 8/2005 | Chen | 439/630 |
| 2001/0010984 | A1 | 8/2001 | Bricaud et al. | |
| 2002/0132527 | A1 | 9/2002 | Ito et al. | |
| 2004/0161977 | A1 * | 8/2004 | Nagata et al. | 439/630 |
| 2004/0192114 | A1 | 9/2004 | Liou | |

FOREIGN PATENT DOCUMENTS

| | | |
|---|---|---|
| EP | 1 229 611 A1 | 8/2002 |
| JP | 2000-353558 | 12/2000 |
| JP | 2002-042932 | 2/2002 |
| WO | WO 2004/025788 A1 | 3/2004 |

OTHER PUBLICATIONS

European Search Report dated May 18, 2006, for Application No. EP 06 10 0119.

* cited by examiner

*Primary Examiner*—Thanh-Tam Le
(74) *Attorney, Agent, or Firm*—Barley Snyder LLC

(57) ABSTRACT

A card connector comprises an insulating housing having a first card receiving slot provided with a plurality of contacts. At least one elastic projection extends into the first card receiving slot. The elastic projection is formed to have a first inclined surface that rises at an inclination in a card insertion direction and a second inclined surface that rises at an inclination in a card removal direction. The second inclined surface is steeper than the first inclined surface. A first card electrically connected to the contacts. The first card is removeably receivable in the first card receiving slot and has a flange protruding from a main surface thereof. The flange is formed to engage the first inclined surface when the first card is inserted in the first card receiving slot and to engage the second inclined surface when the first card is removed from the first card receiving slot.

11 Claims, 9 Drawing Sheets

CARD CONNECTOR

FIELD OF THE INVENTION

The invention relates to a card connector having at least one elastic projection that engages a first card inserted therein for providing a low card insertion force and a high card removal force.

BACKGROUND OF THE INVENTION

FIGS. 7–9C (see JP 2000-353558A) show a first example of a card connector 101 according to the prior art. The card connector 101 is structured so that the force required for removing a card inserted therein is increased while the force required for inserting the card therein is reduced. Thus, the reliability of the card connector is increased due to the increased card holding power.

The card connector 101 comprises an insulating housing 110 and a plurality of contacts 120 that are attached to the housing 110. The housing 110 is substantially rectangular and has a card receiving opening 112 that passes through the housing 110 in a direction of thickness of the housing 110. The card receiving opening 112 is designed so that a card C is inserted into the card receiving opening 112 from a front side (left side in FIG. 7) toward a rear side of the card receiving opening 112 and so that the card C is removed in the opposite direction. A plurality of contact accommodating passages 111 extend from the card receiving opening 112 in a direction perpendicular to the direction of insertion and removal of the card C. The contact accommodating passages 111 are formed so that the contact accommodating passages 111 face each other from above and below on either side of the card receiving opening 112.

Each of the contacts 120 comprises an attachment member 121 that is secured to a side wall of the corresponding contact accommodating passage 111. The attachment member 121 is press-fitted to a rear-end portion of the side wall of the corresponding contact accommodating passage 111. A bent member 122 extends from one end of the attachment member 121. The bent member 122 first extends forward at an inclination from one end of the attachment member 121 and is then bent back to extend rearward at an inclination. A contact member 123 extends from an end of the bent member 122. The contact member 123 includes a contact protruding member 123*b* and a tip 123*a*. The contact member 123 first extends forward at an inclination from the end of the bent member 122 such that the contact protruding member 123*b* protrudes to an interior of the card receiving opening 112. The contact member 123 then extends forward at an inclination after being bent back from the contact protruding member 123*b*. The tip 123*a* of the contact member 123 is accommodated inside the corresponding contact accommodating passage 111. A connecting member 124 extends from the other end of the attachment member 121. The connecting member 124 is connected to an outside of the corresponding contact accommodating passage 111. Each of the contacts 120 may be formed by stamping and forming a metal plate.

As shown in FIG. 8A, when the card C is inserted into the card receiving opening 112, the card C contacts the contact protruding member 123*b* of the contact member 123 so that the contact member 123 is pushed in the direction of insertion of the card C and away from the card receiving opening 112. As shown in FIGS. 8B –8C, the bent member 122 is compressed so that an angle G in a central portion of the bent member 122 is reduced. Consequently, the contact protruding member 123*b* is accommodated inside the contact accommodating passage 111, and the contact member 123 almost in its entirety is positioned at a boundary surface between the contact accommodating passage 111 and the card receiving opening 112. Accordingly, the contact member 123 contacts the card C with its entire surface, which appropriately suppresses the contact pressure that the card C receives from the contact members 123 during the insertion of the card C, thus reducing the force required for the insertion of the card C.

As shown in FIG. 9A, when the card C is removed from the card receiving opening 112, the contact member 123 is dragged in the direction of card removal. As shown in FIGS. 9B –9C, the tip 123*a* of the contact member 123 contacts a front wall of the contact accommodating passage 111. The contact protruding member 123*b* of the contact member 123 rises toward the card receiving opening 112 with the tip 123*a* acting as a fulcrum and strongly presses against the card C after making contact with the card C in a more or less point contact state. The force required for removing the card C is therefore increased, so that the holding power exerted on the card C in the card connector 101 is increased.

In the card connector 101 shown in FIG. 7, however, when the card C is removed from the card receiving opening 112, the contact protruding members 123*b* of the contact members 123 of the contacts 120 come into contact and strongly press against the card C in a more or less point contact state. As a result, the force required for the removal of the card C is increased, and the holding power exerted on the card C is heightened. However, the holding power exerted on the card C is merely increased by the spring force of the contacts 120 so that the holding power exerted on the card C is still not adequate. Therefore, in cases where an external force is applied to the card connector 101, there is still a danger that the card C will drop out of the card connector 101. Since nothing other than the spring force of the contacts 120 is utilized to increase the holding power exerted on the card C, in cases where an external force is applied to the card connector 101, there are cases in which the load applied to the contacts 120 is so excessive that the contacts 120 may be damaged. Moreover, if the spring force of the contacts 120 is increased, there are cases in which the card contact points provided on the card C may also be damaged (e.g., stripping of the plating) as a result of the numerous number of times the card C is inserted and removed.

FIGS. 10A –10B (see JP 2002-42932A) show another example of a card connector 201 according to the prior art. The card connector 201 is structured to reduce the insertion force of a card (not shown) and to prevent the card (not shown) from dropping out.

The card connector 201 comprises an insulating housing 210 and a plurality of contacts 220 that are attached to the housing 210. A card holder 230 is held inside the housing 210 in a pivotable manner. The housing 210 has a base member 211 that extends in a direction of width and side plate members 212*a*, 212*b* that are provided on both ends of the base member 211 in the direction of width. The side plate members 212*a*, 212*b* extend in a card insertion direction X and in a card removal direction Y. A card insertion slot 212 is formed between the side plate members 212*a*, 212*b* at a rear end of the housing 210. A bridge 215 is provided on an upper portion of the side plate members 212*a*, 212*b* at rear ends thereof in the card insertion direction X. Shaft members 213 (only one side is shown in FIG. 10B) are provided on mutually facing inner surfaces of the side plate members 212*a*, 212*b* substantially in a center thereof. First positioning members (not shown) for positioning the card holder 230 in a first position into which the card (not shown) can be inserted into and removed from the card holder 230 and second positioning members 214 for positioning the card holder 230 in a second position into which contact point members (not shown) provided on an bottom surface of the card (not shown) can be caused to contact the contacts 220 are present on mutually facing inner surfaces of the side plate members 212*a*, 212*b* toward the rear ends thereof. The first positioning members (not shown) are provided in a lower portion of the mutually facing inner surfaces of the side plate members 212*a*, 212*b*. The second positioning members 214 are provided in an upper portion of the mutually facing inner surfaces of the side plate members 212*a*, 212*b*.

The contacts 220 are attached to the base member 211 of the housing 210 at a specified pitch along the direction of width. Contact members 221 protrude upward from an upper surface of the base member 211. The contact members 221 are designed to be contacted by contact points (not shown) provided on the bottom surface of the card (not shown) when the card (not shown) is located in the second position.

The card holder 230 comprises a card placement member 231 that extends in a direction of width. Holder side plate members 232*a*, 232*b* are formed by bending both ends of the card placement member 231 in the direction of width so that the holder side plate members 232*a*, 232*b* respectively face the side plate members 212*a*, 212*b*. Guide members 233*a*, 233*b* are formed by bending the holder side plate members 232*a*, 232*b* inward from the side plate members 212*a*, 212*b*. The holder side plate members 232*a*, 232*b* are attached in a pivotable manner to the shaft members 213 that are respectively provided on the side plate members 212*a*, 212*b* of the housing 210. First locking members (not shown) that are locked with the first positioning members (not shown) of the housing 210 and second locking members (not shown) that are locked with the second positioning members 214 are provided on the holder side plate members 232*a*, 232*b* of the card holder 230.

FIG. 10A shows a state in which the first locking members (not shown) of the card holder 230 are locked with the first positioning members (not shown) of the housing 210. At this point, the card holder 230 is substantially parallel to the housing 210 so that the card (not shown) can be inserted into the card holder 230 from the rear end side in the card insertion direction X. In this case, since the front end member of the card holder 230 is away from the contact members 221 of the contacts 220, there is no contact between the card contact point members (not shown) and the contact members 221 of the contacts 220 even when the card (not shown) is inserted. Accordingly, the contact force of the contacts 220 does not affect the card insertion force so that the card (not shown) can be inserted into the card holder 230 with little force.

In contrast, if the rear end of the card is lifted up in the direction of arrow Z1 in FIG. 10B after the card (not shown) has been inserted into a specified position of the card holder 230, the card holder 230 is also caused to rotate with the shafts 213 as fulcrums so that the second locking members (not shown) are locked with the second positioning members 214. The movement of the card holder 230 is thus restricted in the returning direction. As a result, the card holder 230 is fastened in place. The front end member of the card holder 230 moves in the direction of arrow Z2 as a result of the rotation of the card holder 230 so that the card contact points (not shown) of the card (not shown) and the contact members 221 of the contacts 220 come into contact. In this case, a rear end of the card (not shown) is blocked by the locking members 216*a*, 216*b* of the housing 210 so that the card (not shown) is locked into place. Accordingly, the card (not shown) does not drop out of the card holder 230 even if the card connector 201 is tilted in the card removal direction Y.

In the case of the card connector 201 shown in FIGS. 10A–10B, however, although there is no danger of the card (not shown) dropping out of the card holder 230 or of the contacts 220 being damaged, the card holder 230 is necessary to hold the card (not shown). Therefore, the card connector 201 requires extra components and has a complex construction.

BRIEF SUMMARY OF THE INVENTION

It is therefore an object of the invention to provide a card connector which has a simple construction and can securely increase the force required for removing the card while reducing the force required for inserting the card without damaging the contacts or the card contact points while preventing the card from unintentionally dropping out of the card connector.

This and other objects are achieved by a card connector comprising an insulating housing having a first card receiving slot provided with a plurality of contacts. At least one elastic projection extends into the first card receiving slot. The elastic projection is formed to have a first inclined surface that rises at an inclination in a card insertion direction and a second inclined surface that rises at an inclination in a card removal direction. The second inclined surface is steeper than the first inclined surface. A first card electrically connected to the contacts. The first card is removeably receivable in the first card receiving slot and has a flange protruding from a main surface thereof. The flange is formed to engage the first inclined surface when the first card is inserted in the first card receiving slot and to engage the second inclined surface when the first card is removed from the first card receiving slot.

This and other objects are further achieved by a card connector comprising an insulating housing having a first card receiving slot provided with a plurality of contacts. At least one elastic projection extends into the first card receiving slot. A first electrically connects with the contacts. The first card is removeably receivable in the first card receiving slot and has a flange protruding from a main surface thereof that engages the elastic projection. The elastic projection is formed to lift the card upward when the first card is inserted in the first card receiving slot, and the elastic projection is formed to lift the card upward when the first card is removed from the first card receiving slot.

DESCRIPTION OF THE DRAWINGS

FIG. 101B is a perspective view of the card connector of FIG. 10A showing the card connector in a second position.

DETAILED DESCRIPTION OF THE INVENTION

Figure 1A:
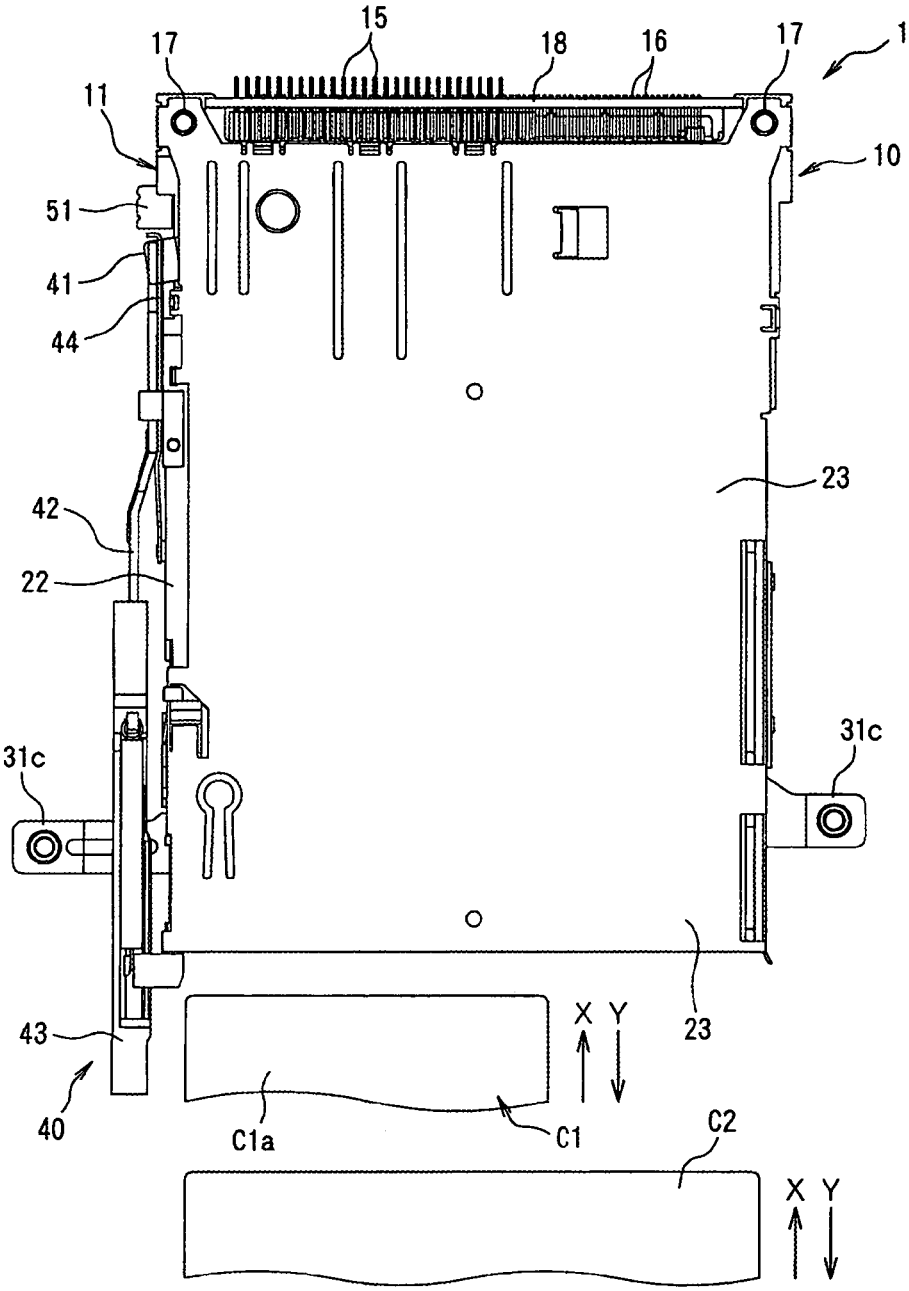
FIG. 1A is a plan view of a card connector according to the invention.

FIGS. 1A –6B show a card connector 1 according to the invention. As shown in FIGS. 1A –1B, the card connector 1 comprises a first card receiving slot 20 into which a first card C1 is inserted in a card insertion direction X and from which the first card C1 is removed in a card removal direction Y. A second card receiving slot 30 is provided substantially beneath the first card receiving slot 20 into which a second card C2 is inserted in the card insertion direction X and from which the second card C2 is removed in the card removal direction Y. The inserted first and second cards C1, C2 are connected via a connection member 10. An interior side in the card insertion direction X shall be referred to herein as a front side, and a side opposite thereof shall be referred to as a rear side.

Figure 6A:
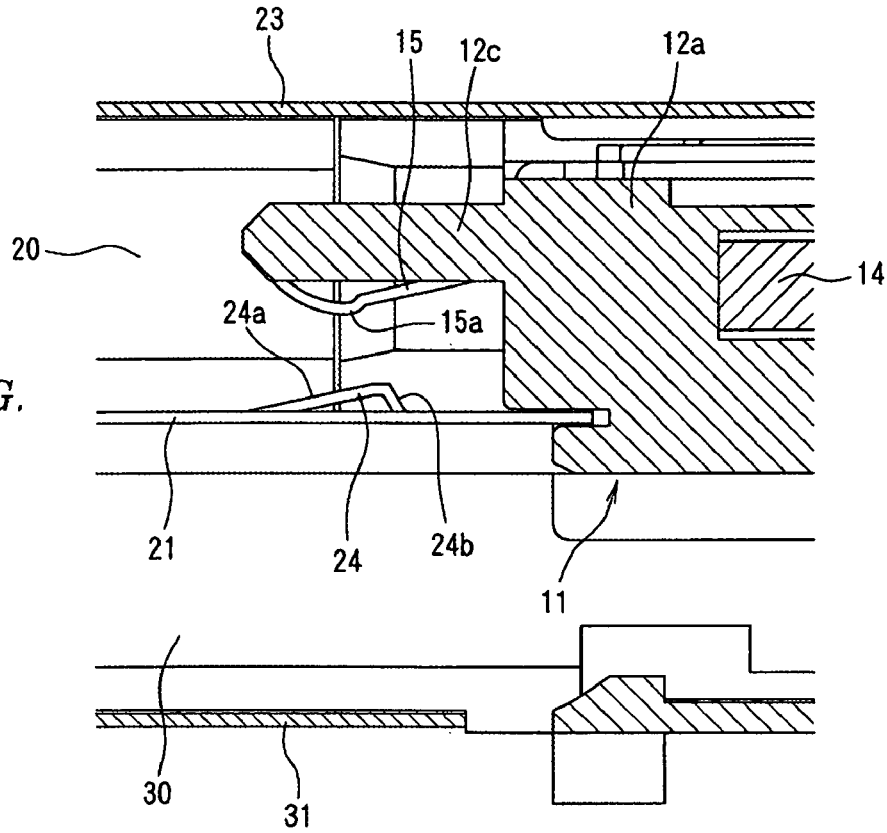
FIG. 6A is a sectional view of the card connector of FIG. 1 prior to insertion of a first card.
Figure 6B:
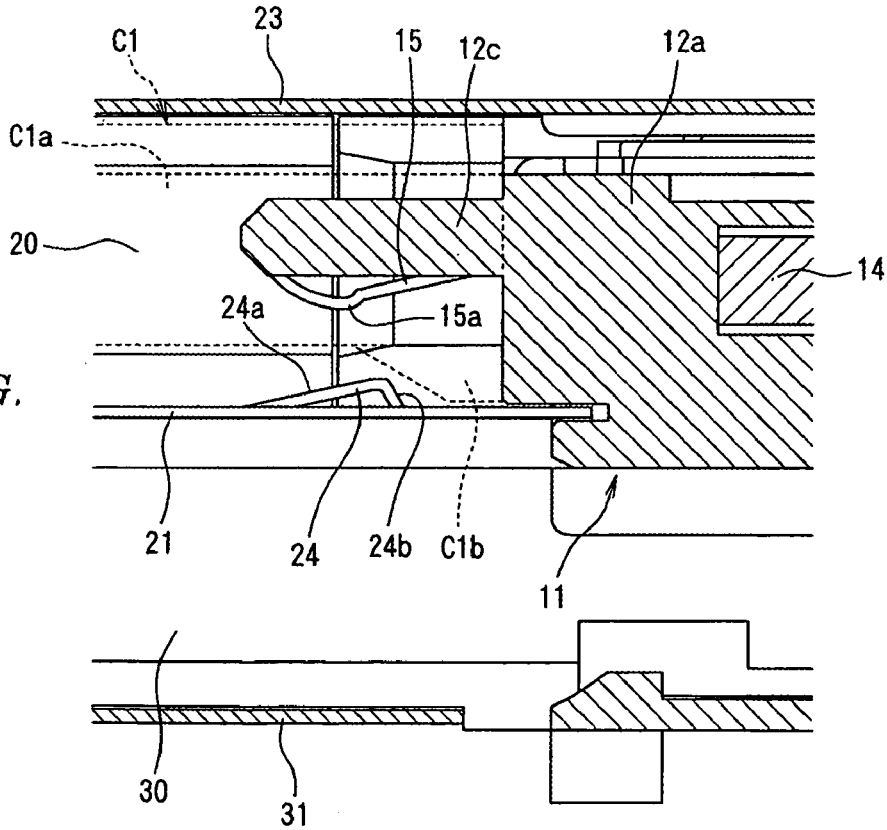
FIG. 6B is a sectional view of the card connector of FIG. 1 following insertion of the first card.
Figure 7:
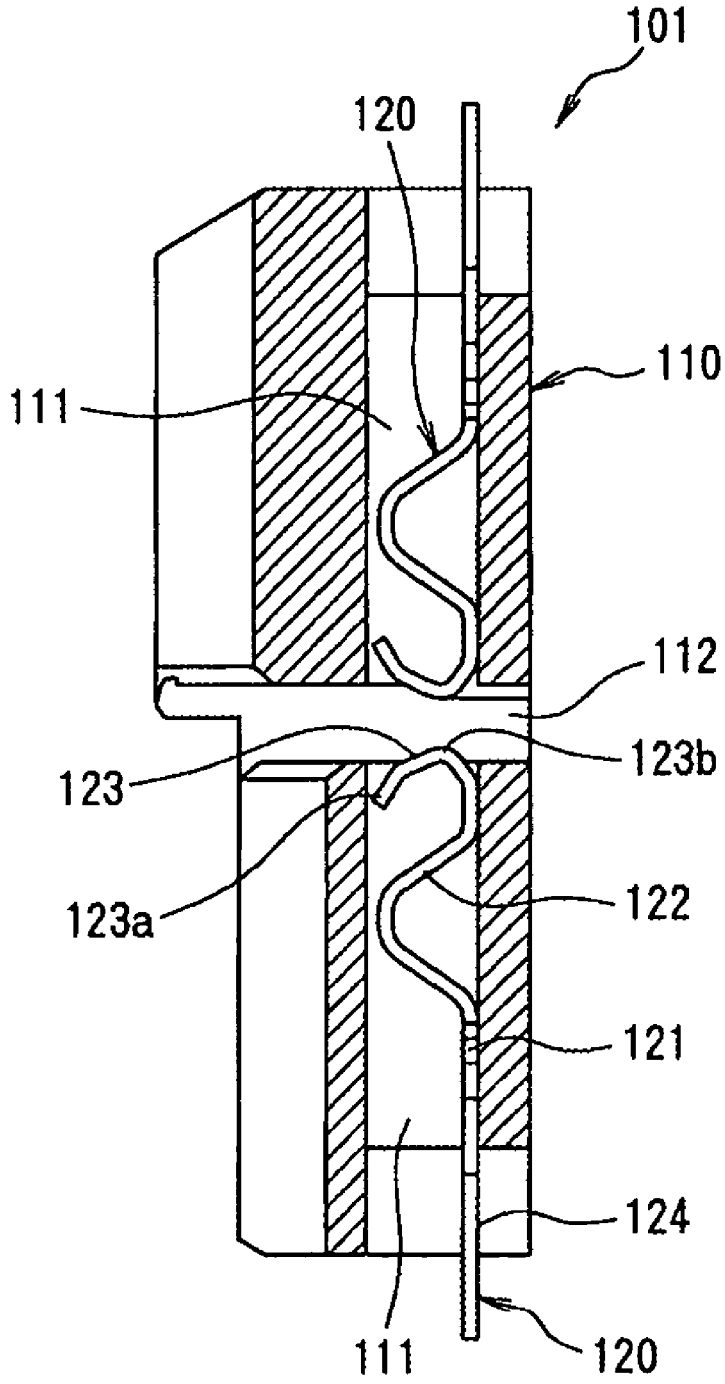
PRIOR ART FIG. 7
FIG. 7 is a sectional view of a card connector according to the prior art.
Figure 8A:
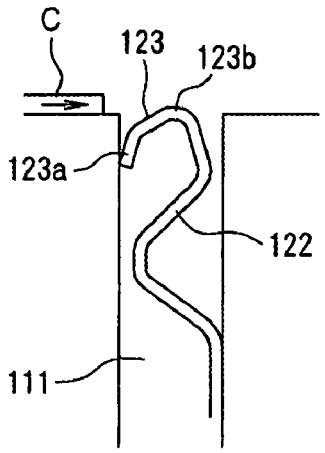
FIG. 8A is a schematic diagram showing insertion of a card into the card connector of FIG. 7.
Figure 8B:
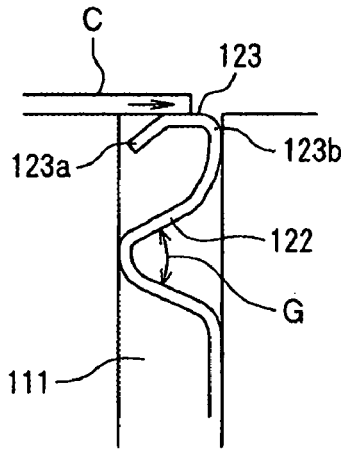
FIG. 8B is a schematic diagram showing insertion of the card into the card connector of FIG. 7.
Figure 8C:
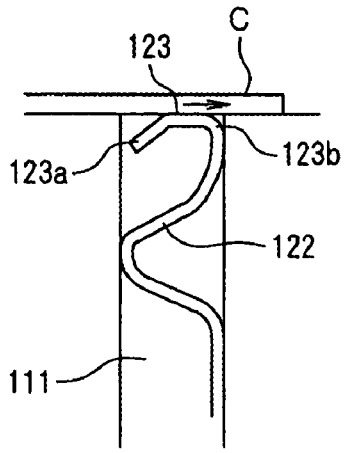
FIG. 8C PRIOR ART
FIG. 8C is a schematic diagram showing insertion of the card into the card connector of FIG. 7.
Figure 9A:
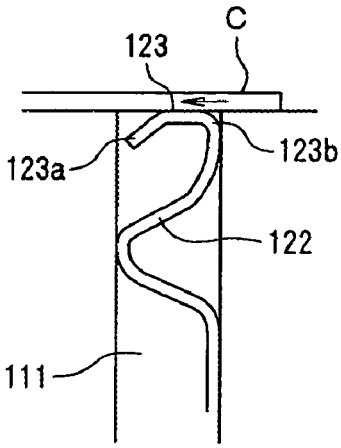
FIG. 9A is a schematic diagram showing removal of the card into the card connector of FIG. 7.
Figure 9B:
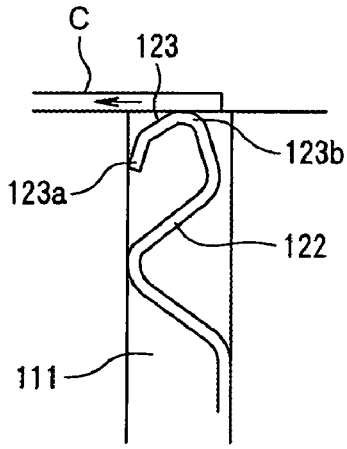
FIG. 9B is a schematic diagram showing removal of the card into the card connector of FIG. 7.
Figure 9C:
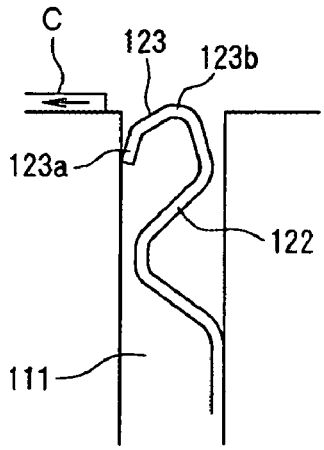
FIG. 9C PRIOR ART
FIG. 9C is a schematic diagram showing removal of the card into the card connector of FIG. 7.
Figure 10A:
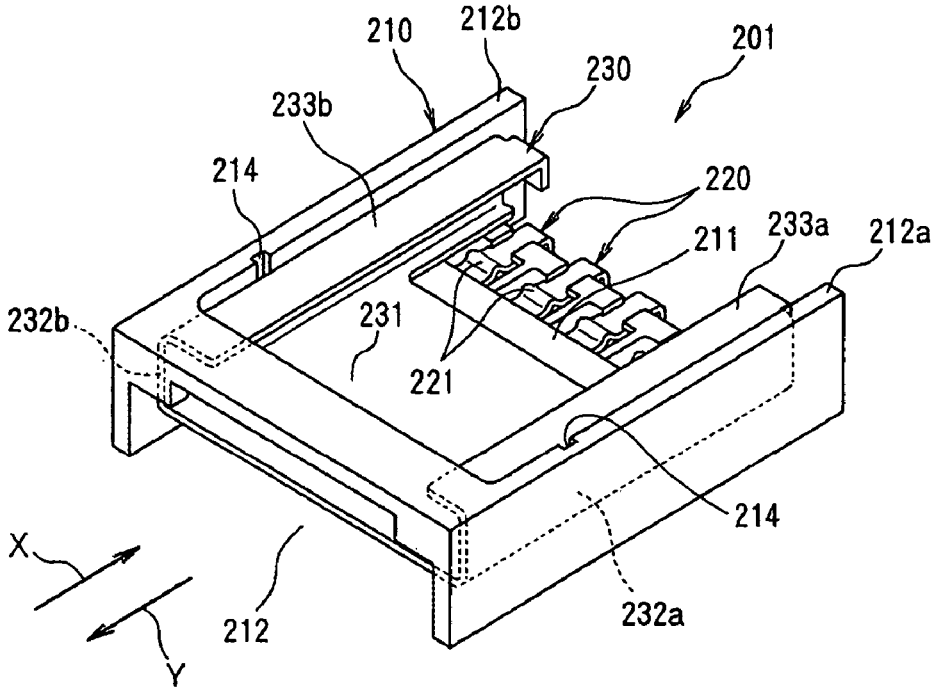
FIG. 10A PRIOR ART
FIG. 10A is a perspective view of another card connector according to the prior art showing the card connector in a first position.
Figure 10B:
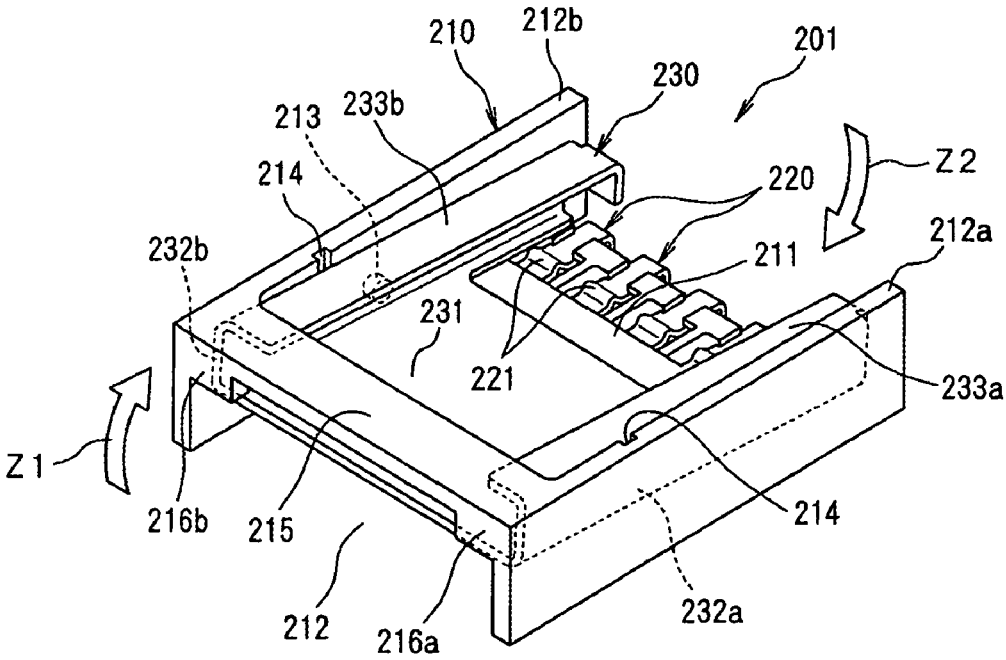
FIG. 10B PRIOR ART

The first card C1 may be, for example, a memory card or "express card" that conforms to Personal Computer Memory Card International Association (PCMCIA) standards. For example, the first card C1 may be of a type that has a first shoulder member in which a first side portion of a front of a main body of the first card C1 is formed in a substantially wide, flat plate cut-out shape or a type that has a narrow width and has substantially straight sides. Both a mating connector member of a wide type express card and a mating connector member of a narrow type express card are the same, so that both the wide type express card and narrow type express card can be inserted into and removed from the first card receiving slot 20. The following description, however, will involve cases in which a wide type express card is inserted and removed there from. As shown in FIGS. 6A –6B, the first card C1 has a main body C1*a* with a front end portion having a flange C1*b* that protrudes from a main surface thereof. In the illustrated embodiment, the flange C1*b* protrudes from a bottom surface of the main body C1. The second card C2 is a conventional personal computer (PC) card according to PCMCIA standards. The second card C2 does not have a flange that protrudes from a main surface thereof.

Figure 2A:
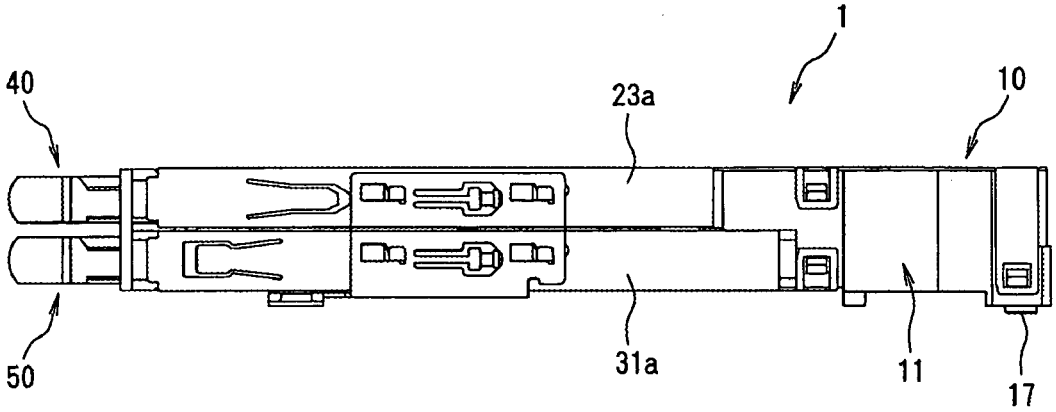
FIG. 2A is a right side view of the card connector of FIG. 1.
Figure 2B:
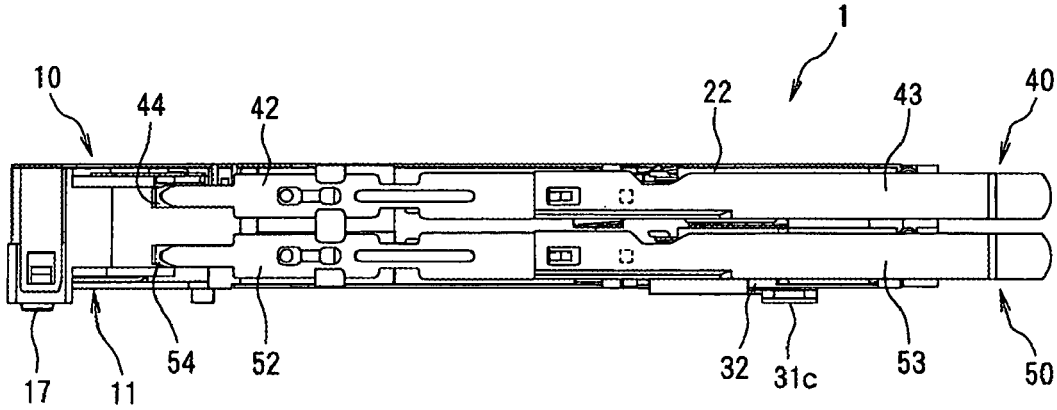
FIG. 2B is a left side view of the card connector of FIG. 1.
Figure 3:
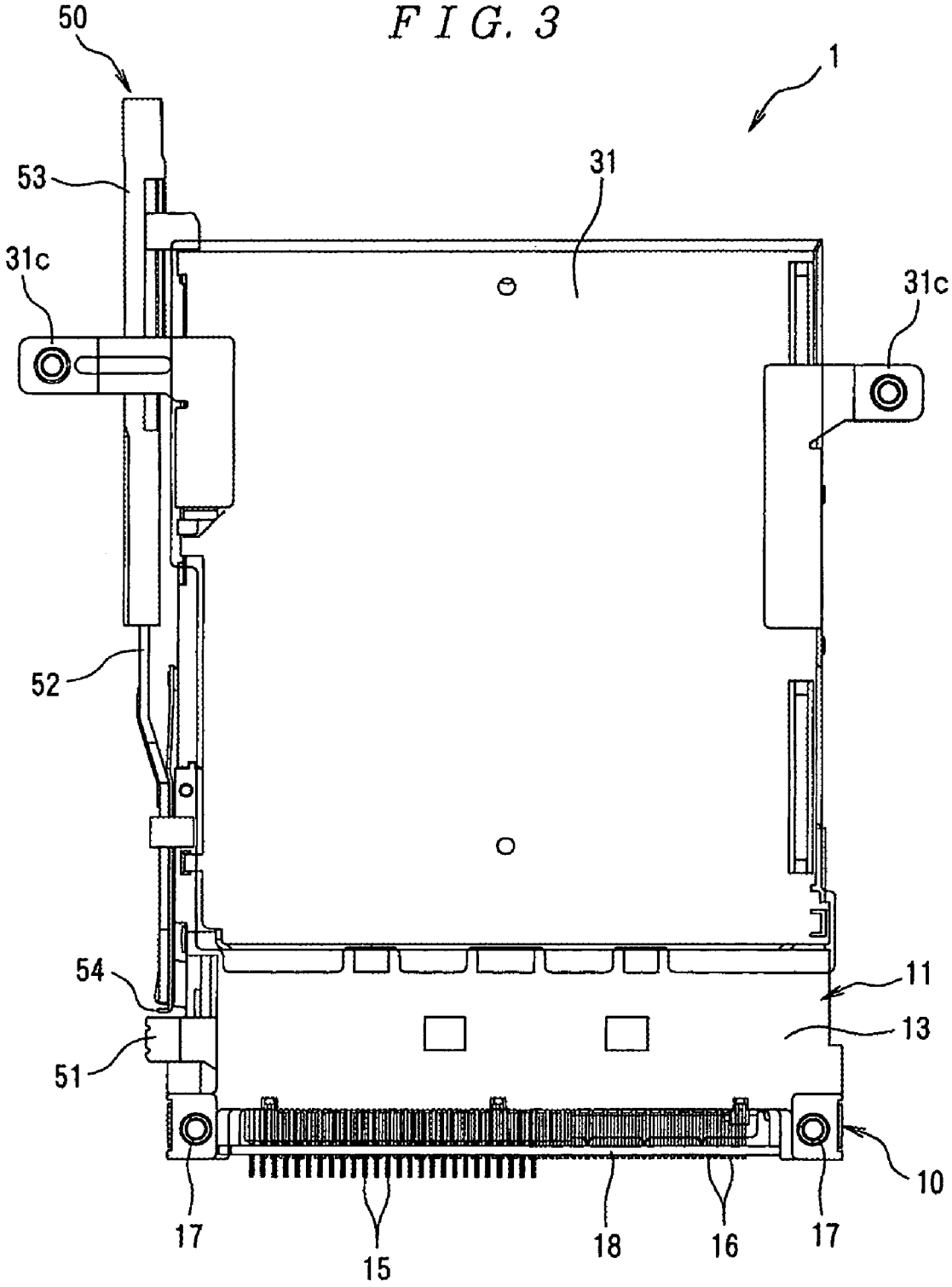
FIG. 3 is a bottom view of the card connector of FIG. 1.
Figure 4:
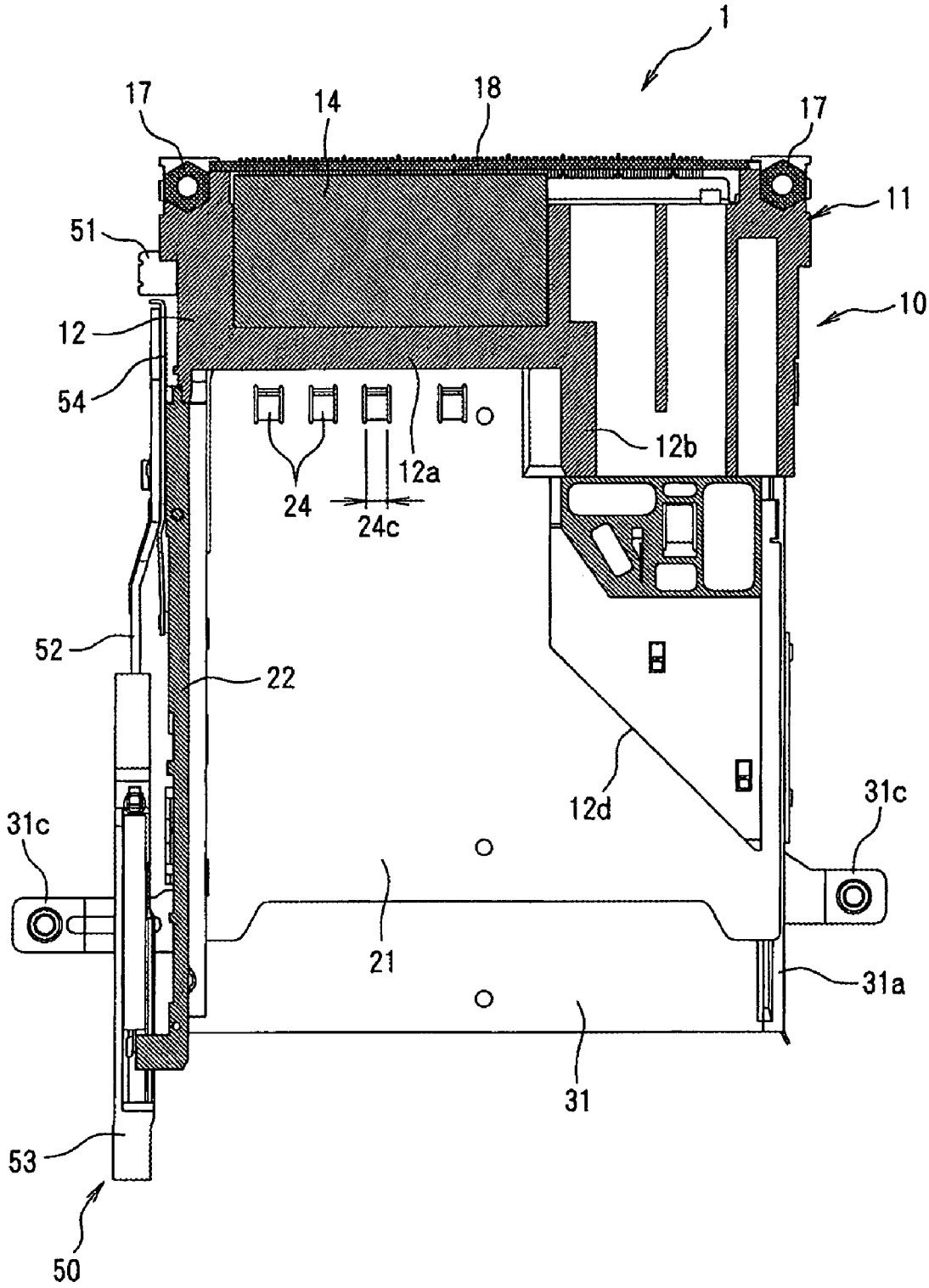
FIG. 4 is a sectional view taken along line 4 —4 of FIG. 1B.
Figure 5:
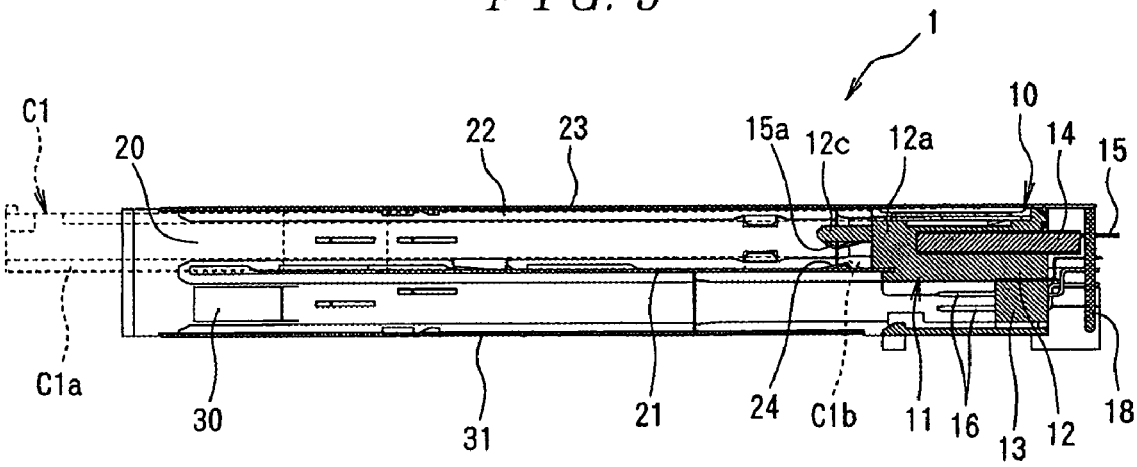
FIG. 5 is a sectional view along line 5 —5 of FIG. 1B.

As shown in FIGS. 2A –2B, the connection member 10 has an insulating housing 11. The housing 11 is provided with screw openings 17 for fastening the housing 11 to a surface of a circuit board (not shown). The housing 11 comprises a first housing 12 and a second housing 13 that is provided beneath the first housing 12, as shown in FIG. 5. The first housing 12 is provided in a position corresponding to the first card receiving slot 20 in a vertical direction and on a front side of the first card receiving slot 20. The first housing 12 comprises an accommodating member 12*a* that accommodates a substantially rectangular body 14 to which a plurality of first contacts 15 that extend in the card insertion direction X are attached. As shown in FIG. 4, a guide member 12*b* is provided on a first side of the accommodating member 12*a* and guides the insertion and removal of a first-side surface of a front end of the first card C1. The guide member 12*b* protrudes toward the rear with respect to the accommodating member 12*a*. An inclined guide surface 12*d* is formed on a rear side of the guide member 12*b*. The inclined guide surface 12*d* has a substantially small width and both sides thereof are substantially straight to the connection member 10. The inclined guide surface 12*d* is formed to lead the first card C1. As shown in FIG. 5, a plate-form member 12*c* is formed on the accommodating member 12*a* and protrudes rearward.

As shown in FIGS. 6A –6B, each of the first contacts 15 has an elastic contact member 15*a* provided on a rear end thereof that elastically contacts a card contact point (not shown) on the first card C1 when the first card C1 is inserted in the card connector 1. The elastic contact members 15*a* are disposed so as to be exposed on a lower side of the platform member 12*c*. A front end of the first contacts 12 is connected, for example, by soldering to a relay substrate 18.

As shown in FIG. 5, the second housing 13 is provided in a position corresponding to the second card receiving slot 30 and is arranged in a vertical direction on a front side of the second card receiving slot 30. A plurality of second contacts 16 that extend in the card insertion direction X are attached to the second housing 13. The second contacts 16 are configured such that rear end members thereof respectively contact contacts (not shown) provided on the second card C2 when the second card C2 is inserted. Front end members of the second contacts 16 are connected by soldering, for example, to the relay substrate 18.

Figure 1B:
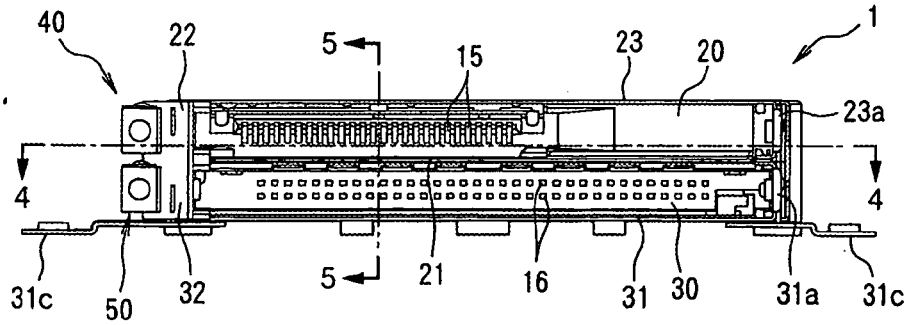
FIG. 1B is a front view of the card connector of FIG. 1.

As shown in FIG. 1B, the first card receiving slot 20 is constructed from a partition frame 21 that forms a division between the first card receiving slot 20 and the second card receiving slot 30. The partition frame 21 is attached to the lower portion of the first housing 12 and extends toward the rear, as shown in FIG. 5. As shown in FIGS. 1A and 5, a first guide arm 22 extends rearward from a second end member of the accommodating member 12*a*. A top shell 23 covers an upper portion of the first housing 12 and first guide arm 22. A first plate member 23*a* is bent downward from a first edge of the top shell 23, as shown in FIG. 1B. When the first card C1 is inserted into and removed from the first card receiving slot 20, an inner surface of the first guide arm 22 guides the second-side surface of the first card C1, and the inner surfaces of the first plate member 23*a* and the guide member 12*b* of the first housing 12 guide the first-side surface of the first card C1. The partition frame 21 and top shell 23 may each be formed, for example, by stamping and forming a metal plate.

As is shown in FIGS. 4 and 6A–6B, a plurality of elastic projections 24 over which the flange C1*b* of the first card C1 climbs when the first card C1 is inserted into the first card receiving slot 20 are formed so as to protrude upward from the front end member of the partition frame 21. As is shown in FIGS. 6A-6B, each of the elastic projections 24 has a first inclined surface 24*a* that rises at a gradual inclination from the partition frame 21 in the card insertion direction X. A second inclined surface 24*b* rises at a substantially steep inclination from the partition frame 21 moving in the card removal direction Y. An apex of the first inclined surface 24*a* and an apex of the second inclined surface 24*b* are connected to each other. Each of the elastic projections 24 is therefore formed in a substantially asymmetrical triangular shape as seen from a side thereof. The elastic projections 24 height is determined by taking into account rattling in a vertical direction, the amount of deformation of the first contacts 15, and the amount of deformation of the elastic projections 24 relative to a height of the flange C1*b*. The first inclined surfaces 24*a* may have an angle of inclination with respect to the partition frame 21 of, for example, approximately 15 degrees and the angle of inclination of the second inclined surfaces 24*b* may have an angle of inclination with respect to the partition frame 21 of, for example, approximately 60 degrees relative to the height of the elastic projections 24.

As shown in FIG. 1B, the second card receiving slot 30 is constructed from the partition frame 21 that forms the division between the first card receiving slot 20 and the second card receiving slot 30. A second guide arm 32 extends rearward from a second end member of the second housing 13. A bottom shell 31 covers a lower portion of the second housing 13, the second guide arm 32, and a plate member 31*a* that is bent upward from a first edge of the bottom shell 31. When the second card C2 is inserted into and removed from the second card receiving slot 30, the inner surface of the second guide arm 32 guides the second-side surface of the second card C2, and the inner surface of the first-side plate member 31*a* guides the first-side surface of the second card C2. A bottom shell 31 covers a lower portion of the second housing 13, the second guide arm 32, and the plate member 31*a*. The bottom shell 31 is provided with fastening members 31*c* for fastening the bottom shell 31 to a circuit board (not shown). The bottom shell 31 may be formed, for example, by stamping and forming a metal plate.

As shown in FIG. 4, a second card ejection member 50 is installed on an external side of the second guide arm 32. The second card ejection member 50 comprises a pivoting arm 51, a push bar 52, and a push plate 54. The pivoting arm 51 is disposed on the second housing 13 in a pivotable manner. The push bar 52 can move along a side surface of the second guide arm 32 in the card insertion direction X and in the card removal direction Y. The push plate 54 is shaft-supported on the push bar 52 in a pivotable manner and pushes and causes the pivoting arm 51 to pivot during the ejection of the second card C2. The pivoting arm 51 is designed to eject the inserted second card C2 in the card removal direction Y as a result of pivoting. A push button 53 may be provided on the push bar 52.

The operation of the card connector 1 will now be described in greater detail. As shown in FIGS. 6A–6B, when the first card C1 is inserted into the first card receiving slot 20, the flange C1*b* formed on the front end portion of the first card C1 contacts the first inclined surfaces 24*a* of the elastic projections 24. The first card C1 advances along the first inclined surfaces 24*a* while pushing the elastic projections 24 downward to climb over the elastic projections 24. Once the flange C1*b* climbs over the elastic projections 24, the insertion of the first card C1 is completed, and the elastic projections 24 return to their original positions. Since the elastic projections 24 undergo elastic deformation, it is possible to reduce the force required for the insertion of the first card C1. Additionally, since the first inclined surfaces 24*a* of the elastic projections 24 are designed to rise at a gradual inclination from the partition frame 21 in the card insertion direction X, the force required for inserting the first card C1 can be further reduced. Upon the completion of the insertion of the first card C1, the elastic contact members 15*a* of the first contacts 15 make elastic contact with the card contact points (not shown) of the first card C1, so that electrical connection occurs between the card contact points (not shown) and the first contacts 15.

When the first card C1 is removed from the first card receiving slot 20, the first card C1 is moved in the card removal direction Y. The flange C1*b* of the first card C1 then contacts the second inclined surfaces 24*b* of the elastic projections 24. The flange C1*b* retracts along the second inclined surfaces 24*b* while pushing the elastic projections 24 downward to climb over the elastic projections 24. Once the flange C1*b* climbs over the elastic projections 24, the ejection of the first card C1 is completed. When the first card C1 is removed from the first card receiving slot 20, the flange C1*b* must climb over the elastic projections 24, so that the force required for removing the first card C1 can be securely increased. Accordingly, the holding power exerted on the first card C1 is made sufficient, so that there is no danger of the first card C1 accidentally dropping out of the card connector 1 in cases where an external force is applied to the card connector 1. Additionally, since a force other than the elastic force of the first contacts 15 is utilized in order to hold the first card C1, the load applied to the first contacts 15 can be minimized in cases where an external force is applied to the card connector 1 so that damage to the first contacts 15 can be avoided. Moreover, there is no damage to the card contact points (not shown) provided on the first card C1, such as stripping of the plating, as a result of numerous insertions and removals of the first card C1.

The card connector 1 is devised so that the flange C1*b* of the first card C1 must climb over the elastic projections 24, and the holding power exerted on the first card C1 can be sufficiently increased by this alone. The second inclined surfaces 24*b* of the elastic projections 24 rise at a steep inclination from the partition frame 21 moving toward the card removal direction Y compared to the first inclined surfaces 24*a*. Thus, an even greater force is required when the flange C1*b* of the first card C1 climbs over the elastic projections 24, so that the holding power exerted on the first card C1 can be increased even further. The adjustment of the insertion and removal forces of the first card C1 can easily be accomplished by varying the number of the elastic projections 24 and the width 24*c* of the elastic projections 24. Since the elastic projections 24 are provided on the bottom member of the first card receiving slot 20, such a degree of freedom is obtained. Therefore, in order to increase the holding power exerted on the first card C1, there is no need to install, for example, any member that makes elastic contact with the side surface of the first card C1 other than the elastic projections 24. In cases where the elastic projections 24 are disposed on the side surface of the first card receiving slot 20, such a degree of freedom is not obtained.

An embodiment of the present invention was described herein. The invention, however, is not limited to this embodiment, and various alterations or modifications are possible without departing from the scope of the invention. For example, the card connector 1 may be formed so that the first card receiving slot 20 is disposed beneath the second card receiving slot 30, so that the card connector 1 has only the first card receiving slot 20 or so that the card connector 1 has two tiers of the first card receiving slots 20. Additionally, the elastic projections 24 may also be provided on the bottom shell 31 of the second card receiving slot 30. Moreover, the configuration of the elastic projections 24 is not limited to that described herein, as long as the elastic projections 24 elastically deform when the flange C1*b* of the first card C1 climbs over the elastic projections 24. In addition, it would also be possible to dispose a first card ejection member 40 on the external side of the first guide arm 22 of the first card receiving slot 20. In this case, it would be sufficient if the first card ejection member 40 comprises a pivoting arm 41 that is disposed on the first housing 12 in a pivotable manner, a push bar 42 that can move in the card insertion and card removal directions X, Y along the side surface of the first guide arm 22, and a push plate 44 that is shaft-supported on the push bar 42 in a pivotable manner that pushes and causes the pivoting arm 41 to pivot during the ejection of the first card C1. The pivoting arm 41 would be designed to eject the inserted first card C1 in the card removal direction Y as a result of pivoting. Moreover, a push button 43 could be provided on the push bar 42. Additionally, in cases where the first card C1 is inserted into the first card receiving slot 20 upside down, the elastic projections 24 could be provided on the top shell 23.

What is claimed is:

1. A card connector, comprising:

an insulating housing having a first card receiving slot provided with a plurality of contacts the insulating housing having an accomodating member,and a plate-form member protuding from the accomodating member,an elastic contact member of each of the contacts being exposed on a lower side of the plate-form member;

at least one elastic projection having a first inclined surface that rises at an inclination in a card insertion direction and a second inclined surface that rises at an inclination in a card removal direction, the second inclined surface being steeper than the first inclined surface, the first and second inclined surfaces of the one elastic projection extending into the first card receiving slot in a position opposing the elastic contact member ; and a first card that electrically connects with the contacts, the first card being removably receivable in the first card receiving slot and having a flange protruding from a main surface thereof, the flange being formed to engage the first inclined surface when the first card is inserted in the first card receiving slot and engage the second inclined surface when the first card is removed from the first card receiving slot.

2. The card connector of claim 1, wherein an apex of the first inclined surface is connected to an apex of the second inclined surface.

3. The card connector of claim 1, wherein the first card is a personal computer card.

4. The card connector of claim 1, further comprising a second card receiving slot that removably receives a second card and a partition frame dividing the first and second card receiving slots, the elastic projection extending from the partition frame.

5. The card connector of claim 4, wherein the partition frame and the elastic projection are integrally formed from a metal sheet.

6. A card connector, comprising:

an insulating housing having a first card receiving slot provided with a plurality of contacts, the insulating housing having an accommodating member and a plate-form member protruding from the accommodating member, an elastic contact member of each of the contacts being exposed on a lower side of the plate-form member contacts;

at least one elastic projection extending into the first card receiving slot in a position opposing the elastic contact member; and a first card that electrically connects with the contacts, the first card being removably receivable in the first card receiving slot and having a flange protruding from a main surface thereof that engages the elastic projection, the elastic projection being formed to lift the card upward when the first card is inserted in the first card receiving slot and the elastic projection being formed to lift the card upward when the first card is removed from the first card receiving slot.

7. The card connector of claim 6, wherein the elastic projection has a first inclined surface that rises at an inclination in a card insertion direction and a second inclined surface that rises at an inclination in a card removal direction, the second inclined surface being steeper than the first inclined surface.

8. The card connector of claim 7, wherein an apex of the first inclined surface is connected to an apex of the second inclined surface.

9. The card connector of claim 6, wherein the first card is a personal computer card.

10. The card connector of claim 6, further comprising a second card receiving slot that removably receives a second card and a partition frame dividing the first and second card receiving slots, the elastic projection extending from the partition frame.

11. The card connector of claim 10, wherein the partition frame and the elastic projection are integrally formed from a metal sheet.

* * * * *

UNITED STATES PATENT AND TRADEMARK OFFICE

CERTIFICATE OF CORRECTION

PATENT NO. : 7,247,055 B2
APPLICATION NO. : 11/327080
DATED : July 24, 2007
INVENTOR(S) : Yoshinori Watanabe It is certified that error appears in the above-identified patent and that said Letters Patent is hereby corrected as shown below:

Col. 9, line 24, insert -- , -- after “contacts”;

Col. 9, line 25, delete “,” after “member”;

Col. 9, line 27, insert a space before “an elastic contact member”;

Col. 9, line 35, insert -- at least -- after “surfaces of the”; and

Col. 10, line 16, delete “contacts” after “member.”

Signed and Sealed this

Twenty-third Day of October, 2007

JON W. DUDAS
*Director of the United States Patent and Trademark Office*